US012403409B2

(12) United States Patent
Meng

(10) Patent No.: US 12,403,409 B2
(45) Date of Patent: Sep. 2, 2025

(54) CURLY HAIR DOLL

(71) Applicant: Zhiyan Meng, Guangdong (CN)

(72) Inventor: Zhiyan Meng, Guangdong (CN)

( * ) Notice: Subject to any disclaimer, the term of this patent is extended or adjusted under 35 U.S.C. 154(b) by 256 days.

(21) Appl. No.: 18/345,264

(22) Filed: Jun. 30, 2023

(65) Prior Publication Data

US 2024/0416251 A1 Dec. 19, 2024

(30) Foreign Application Priority Data

Jun. 19, 2023 (CN) ..... 202321569368.0

(51) Int. Cl.
*A63H 3/44* (2006.01)
*A63H 3/02* (2006.01)
*A63H 9/00* (2006.01)

(52) U.S. Cl.
CPC ..... *A63H 3/44* (2013.01); *A63H 3/02* (2013.01); *A63H 9/00* (2013.01)

(58) Field of Classification Search
CPC ..... A63H 3/44; A63H 9/00; A63H 37/00
See application file for complete search history.

(56) References Cited

U.S. PATENT DOCUMENTS

| | | | | |
|---|---|---|---|---|
| 5,180,325 | A * | 1/1993 | Eddins | A63H 3/44 446/385 |
| 5,607,338 | A * | 3/1997 | Landi | A63H 3/44 446/296 |
| 5,807,159 | A * | 9/1998 | Watkins | A63H 37/00 83/924 |
| 10,786,747 | B2 * | 9/2020 | Choi | A63H 3/44 |
| 2006/0141900 | A1 * | 6/2006 | Wesley | A63H 3/44 446/394 |
| 2017/0055616 | A1 * | 3/2017 | Swoope | A63H 3/44 |

* cited by examiner

*Primary Examiner* — John A Ricci
(74) *Attorney, Agent, or Firm* — Dorsey & Whitney LLP

(57) ABSTRACT

Systems and methods related to a curly hair doll are provided. A doll includes a head and a plurality of material strands coupled to the head to embody curls of hair. Each material strand may define a three-dimensional (3D) helix formed by a two-dimensional (2D) spiral cut into a flat piece of flexible material. Additional systems and associated methods are also provided.

20 Claims, 10 Drawing Sheets

CURLY HAIR DOLL

CROSS-REFERENCE TO RELATED APPLICATION

This application claims priority under 35 U.S.C. § 119 (a)-(d) to Chinese Utility Model application No. 202321569368.0, filed on Jun. 19, 2023, which is hereby incorporated by reference for all purposes.

TECHNICAL FIELD

The present disclosure relates generally to dolls, and, more particularly, to systems and methods related to curly hair dolls.

BACKGROUND

Conventional dolls often include features to resemble real or lifelike features, such as curly hair. However, the hair curls of these dolls may not be robust and diminish over time. Therefore, a need exists for improved curly hair doll systems and methods.

BRIEF SUMMARY

Various embodiments of the present disclosure include a doll. The doll includes a head and a plurality of material strands coupled to the head to embody curls of hair. Each material strand may define a three-dimensional (3D) helix formed by a two-dimensional (2D) spiral cut into a flat piece of flexible material.

Various embodiments of the present disclosure include a method of making a doll. The method includes coupling a plurality of material strands to a head of the doll. Each material strand may define a 3D helix formed by a 2D spiral cut into a flat piece of flexible material.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

Figure 1A:
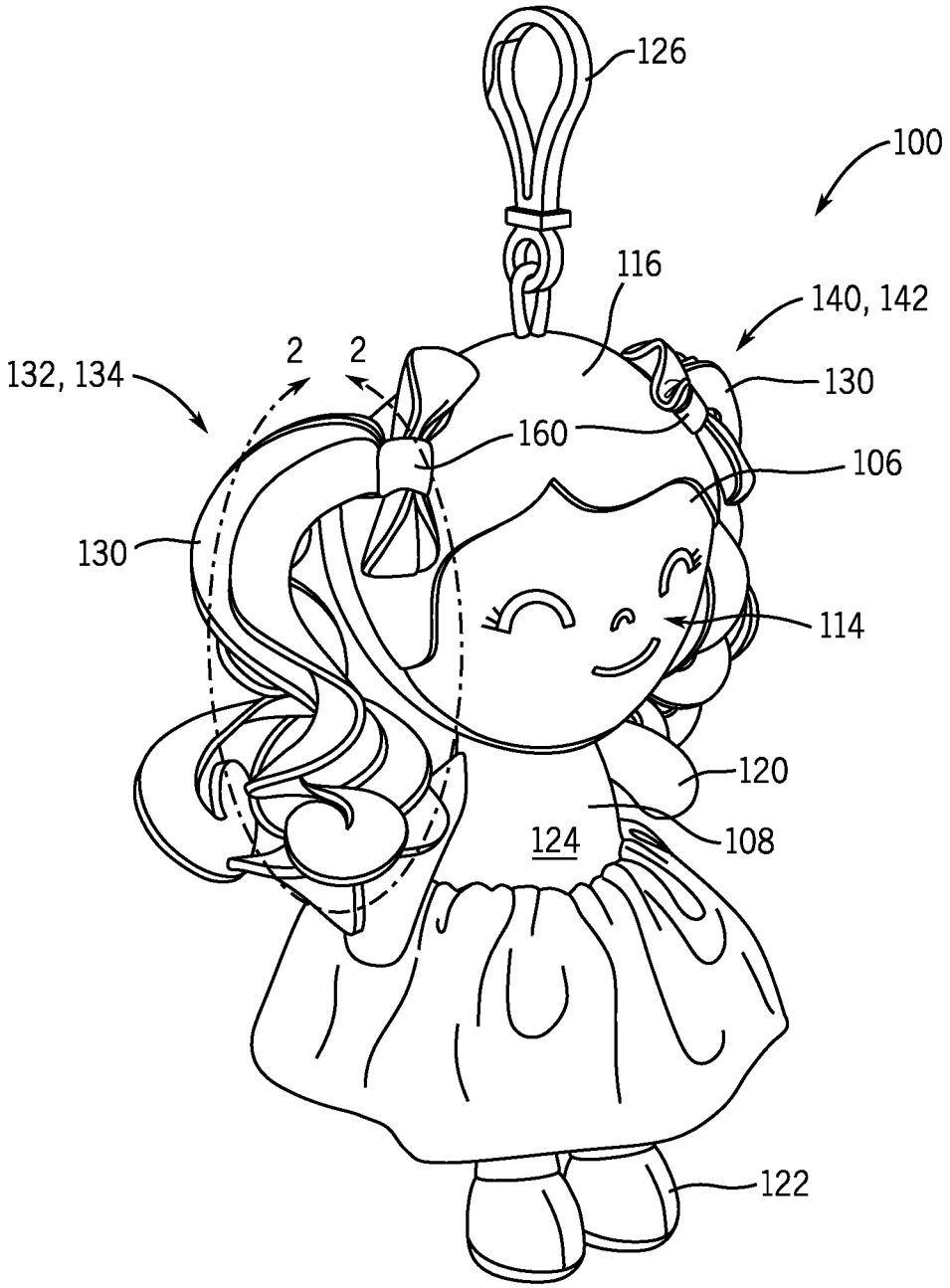
FIG. 1A is a perspective view of a doll, according to one or more embodiments of the disclosure.

Embodiments of the present disclosure and their advantages are best understood by referring to the detailed description that follows. It is noted that sizes of various components and distances between these components are not drawn to scale in the figures. It should be appreciated that like reference numerals are used to identify like elements illustrated in one or more of the figures.

DETAILED DESCRIPTION

Embodiments of the present disclosure are directed to systems and methods related to curly hair dolls. A flexible piece of material may be cut (e.g., die cut) into a two-dimensional (2D) spiral, such that once extended, the 2D spiral forms a three-dimensional (3D) helix-type shape. These material strands may be coupled to the head of a doll to embody curls of hair. The shape of the 2D spiral and/or the 3D helix may provide a desired curl and/or bounce-back level or characteristic, such as a desired curl shape when the material strands are extended under their own weight. The material strands may bounce-back to their original curl shapes after user manipulation, such as regardless of degree or time of user manipulation, thereby providing curls that remain constant or generally constant throughout the doll's useful life.

FIG. 1A is a perspective view of a doll, according to one or more embodiments of the disclosure. Referring to FIG. 1, a doll 100 (e.g., a toy doll) may include a head 106 and a body 108 of certain shapes and configurations to embody various human, animal, or other object characteristics. For instance, the doll 100 may be a human doll, an animal doll, or any other doll, such as to be used as a children's toy, although other configurations are contemplated.

As shown without intent to limit, the doll 100 embodies a human and includes human-like elements or features, such as hair, arm, and leg-like elements, among others. For example, the head 106 may include facial expressions 114 and a hair region 116. The facial expressions 114 may be fixed or set, such as by stitching operations to define eyes, a nose, and a mouth, or any combination thereof. In addition or separately, the facial expressions 114 may be defined by one or more elements attached to the head 106. In embodiments, the facial expressions 114 may be defined by movable, reconfigurable, or actuatable elements representing the eyes, nose, or mouth, or any combination thereof. The hair region 116 may be defined or set off by stitching, material, material color, or material texture, among other distinguishing elements. The body 108, which is coupled to the head 106 such as by stitching, may include various combinations of arms 120 and/or legs 122 attached to a torso 124. In embodiments, the body 108 may include fabric or other material embodying clothing (e.g., a dress, skirt, shirt, pants, shorts, etc.). In embodiments, the clothing may be removable from the body 108. In addition or separately, the clothing material may define at least portions of the body 108 itself.

In embodiments, the doll 100 may be a soft or plush doll stuffed with flexible material, such as natural or synthetic fiber, batting, cotton, straw, wood wool, plastic pellets, etc. Depending on the application, the doll 100 may be realistic in relative dimensions/sizing or may include abnormal dimensions or sizing, such as having an enlarged head size compared to body size, among other variations. In embodiments, the doll 100 may include various accessories, such as one or more hair, shoe, or clothing accessories, etc. The doll 100 may include a clip 126 to couple the doll 100 to an object, such as a backpack, stand, lanyard, rope, etc.

Figure 1B:
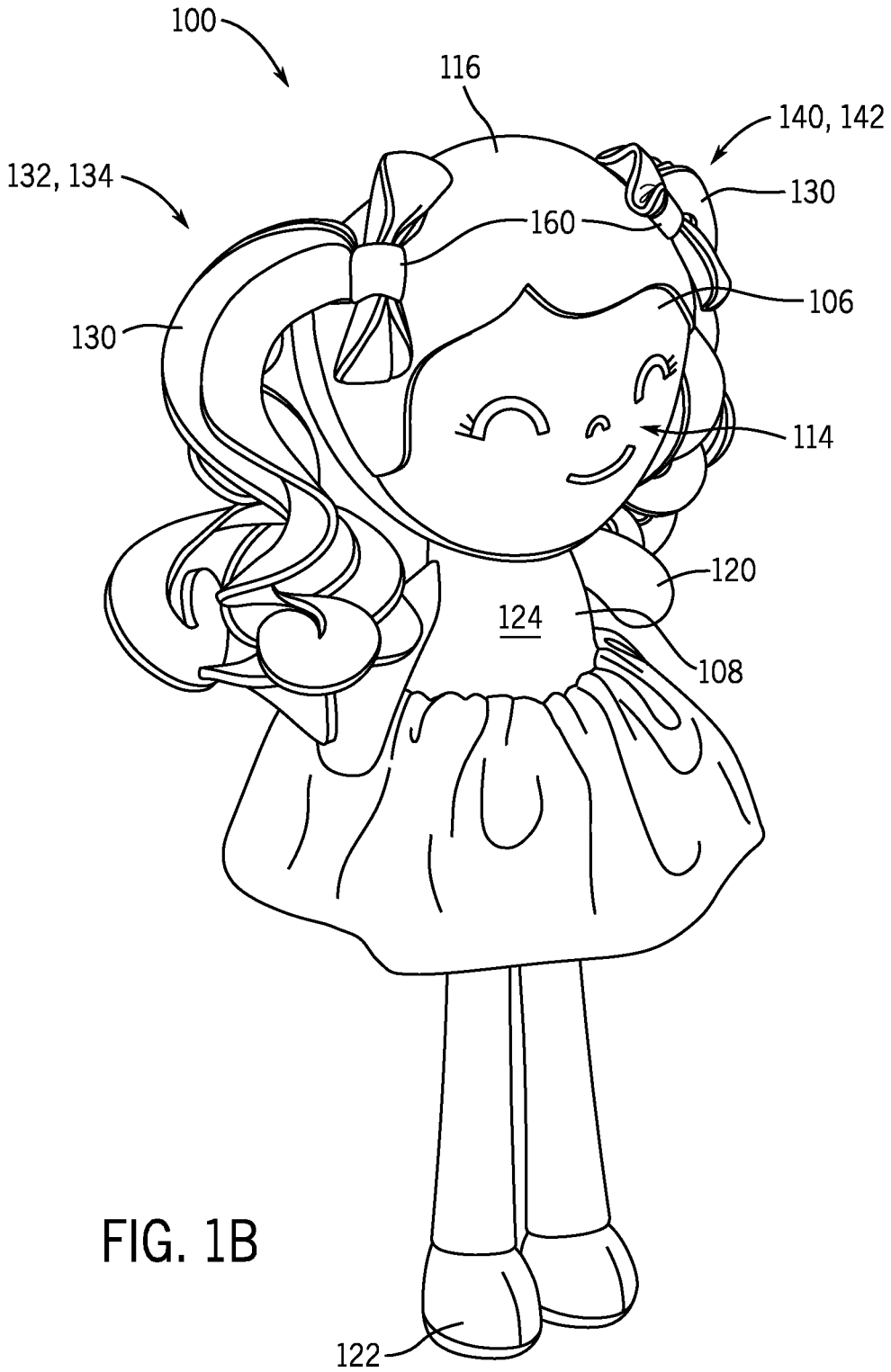
FIG. 1B is a perspective view of an alternative configuration of the doll, according to one or more embodiments of the disclosure.

FIG. 1B is a perspective view of an alternative configuration of the doll 100, according to one or more embodiments of the disclosure. Except as otherwise noted below, the doll 100 illustrated in FIG. 1B includes similar features as described above with reference to FIG. 1A. Referring to FIG. 1B, the doll 100, or at least some features thereof, may include different proportions. For example, the legs 122 may be lengthened compared to the embodiment illustrated in FIG. 1A to embody a larger or taller doll. In some embodiments, the legs 122 may include a length similar to the torso 124 or a length greater than the torso 124. Additionally, or alternatively, the doll 100 illustrated in FIG. 1B may be devoid of one or more features described above. For instance, the doll 100 of FIG. 1B does not include the clip 126.

Figure 2:
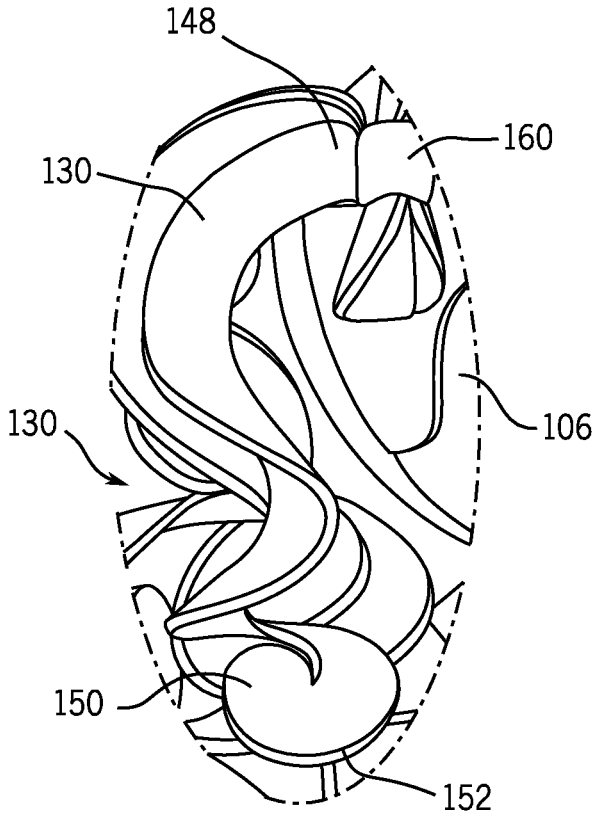
FIG. 2 is an enlarged, fragmentary view of the doll of FIG. 1 and taken along detail 2-2 of FIG. 1.

FIG. 2 is an enlarged, fragmentary view of the doll 100 of FIG. 1 and taken along detail 2-2 of FIG. 1. Referring to FIGS. 1-2, one or more, such as a plurality of, material strands 130 are coupled to the head 106 to embody curls of hair. For instance, as shown in FIG. 1, a first plurality of material strands 132 may be coupled together to define a first pigtail or bunch 134, and a second plurality of material strands 140 may be coupled together to define a second pigtail or bunch 142, although other configurations are contemplated. The first and second pigtails 134, 142 may be coupled to opposite sides of the head 106, such as left and right sides of the head 106, respectively.

As best illustrated in FIG. 2, each material strand 130 may include a first end 148 attached to the head 106, and an unattached second end 150 including a rounded end 152. In embodiments, the doll 100 includes a hair accessory 160 at each attachment of a pigtail to the head 106 (e.g., at the first ends 148 of the material strands 130). Although a bow is illustrated, the hair accessory 160 may include a bow, a pin, a band, or a clamp, or any combination thereof. The hair accessory 160 may at least partially conceal the pigtail's attachment to the head 106 and/or otherwise add visual interest to the doll 100.

The material strands 130 may be formed from flexible material such that the material strands 130 can move and flow (e.g., similar to hair), such as during play of the doll 100. Some example materials include velvet, crystal velvet, felt, linen, and cloth, without intent to limit. In embodiments, the material strands 130 may be formed of multiple layers of material. For instance, the material strands 130 may be formed of two layers of crystal velvet, although other materials and configurations are contemplated. The multiple layers of material may be laminated (e.g., with adhesive in high temperature) or connected in other manners.

In embodiments, each material strand 130 may be shaped and configured to provide a desired level or characteristic of curl and/or bounce-back. For instance, each material strand 130 may define a curl shape when extended, such as in a natural extended state under its own weight as shown in FIGS. 1-2. The material strand 130 may be configured to achieve a certain weight so that a 3D spiral of the material strand 130 can bounce back to a 2D shape. User manipulation (e.g., pulling, stretching, lifting, etc.) of the material strand 130 may temporarily alter the curl. However, the material strands 130 may bounce-back to their original curl shapes once released by the user. This bounce-back may occur regardless of degree or time of user manipulation. For example, the material strands 130 may bounce-back to their original curl shapes even after extended use or play of the doll 100. In this manner, the shape of the material strands 130 in their natural extended states may remain constant or generally constant throughout the doll's useful life.

Figure 3:
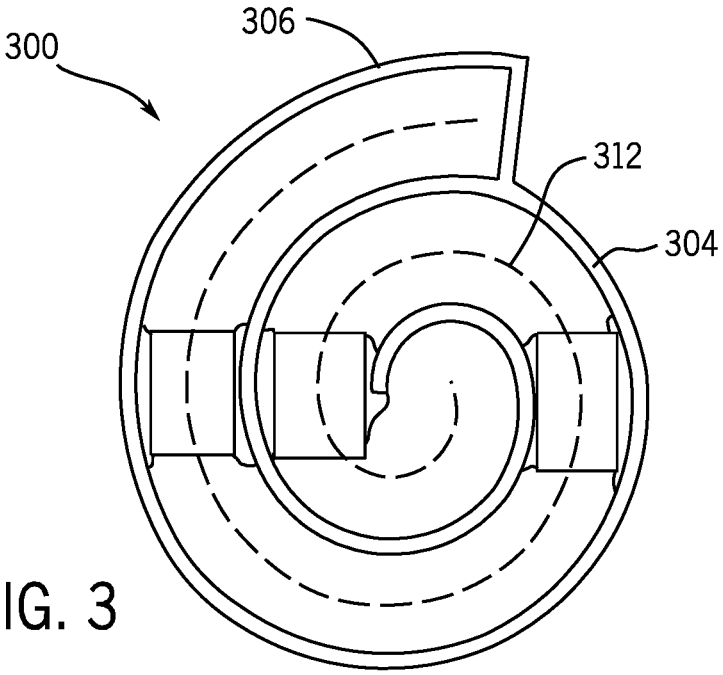
FIG. 3 is an end view of a die used in forming a material strand configured to embody a curl of hair, according to one or more embodiments of the disclosure.
Figure 4A:
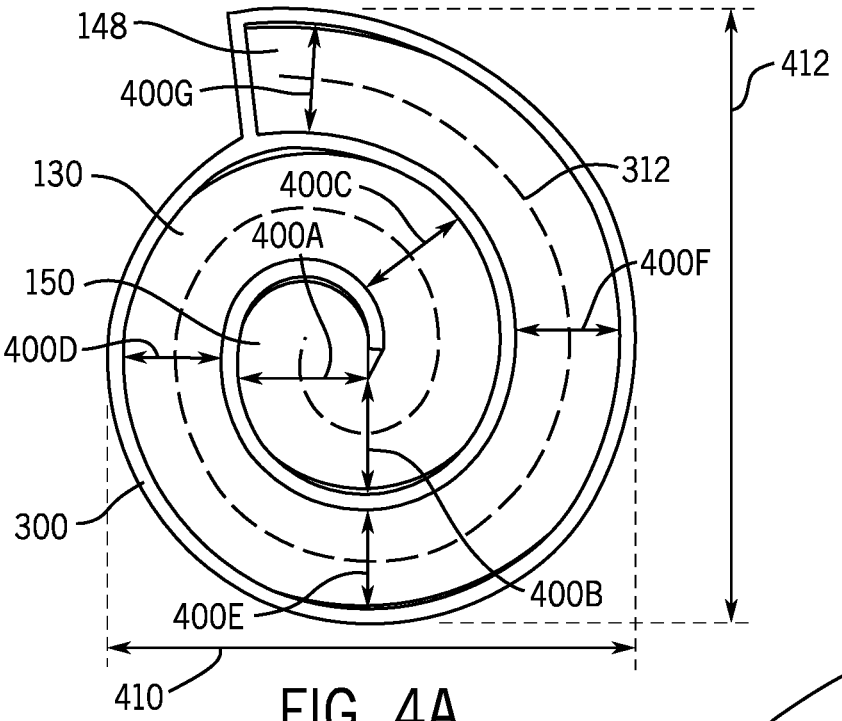
FIG. 4A is a diagram illustrating the formed material strand within the die after stamping, according to one or more embodiments of the disclosure.

FIG. 3 is an end view of a die 300 used in forming the material strands 130, according to one or more embodiments of the disclosure. FIG. 4A is a diagram illustrating a formed material strand 130 within the die 300 after stamping, according to one or more embodiments of the disclosure. Referring to FIG. 3, the die 300 includes a die body 304 having a cutting edge 306. As shown, the cutting edge 306 defines a 2D spiral 312 (as shown in dashed lines in FIG. 3). The 2D spiral 312 may include many forms to define the curl shape of the material strands 130. For example, the 2D spiral 312 may include an Archimedean spiral, an involute spiral, or an Atzema spiral, among other spiral shapes.

Referring to FIG. 4A, the die 300 is used to stamp the 2D spiral 312 into a flat piece of flexible material, such as the materials listed above. As shown, the die 300 may define the first end 148 and the second end 150 with a spiral of material therebetween. The die 300 may form any suitable number of spiral revolutions in the material strand 130, such as less than one revolution, one revolution, two revolutions, more than two revolutions, or multiples of revolutions (e.g., 1.5 revolutions, 1.75 revolutions, 2.25 revolutions, 2.75 revolutions, etc.). In embodiments, the 2D spiral 312 may curve spirally outward through a certain angle from its second end 150 to its first end 148 to define a desired number of revolutions and/or length of the material strand 130. For instance, the 2D spiral 312 may spirally curve less than 720-degrees, greater than 720-degrees, between 810-degrees and 900-degrees (e.g., about 858.35-degrees), or any other angle to define the length of the material strand 130 between the first and second ends 148, 150. In some examples, the 2D spiral 312 may spirally curve less than $4\pi$ radian, greater than $4\pi$ radian, between $4.5\pi$ radian and $5\pi$ radian, about $4.75\pi$ radian, etc.

The width of the material strand 130 may be generally uniform or vary along the length of the material strand 130. For instance, as illustrated in FIG. 4A, the material strand 130 includes various widths along its length, such as a width 400A, a width 400B, a width 400C, a width 400D, a width 400E, a width 400F, and a width 400G at the locations shown, among other widths and locations. In one embodiment, the widths 400A-400G may be equal or substantially equal. In other embodiments, the widths 400A-400G may vary. For instance, in one example, width 400A may be about 1.4 cm, width 400B may be about 1.4 cm, width 400C may be about 1.4 cm, width 400D may be about 1.4 cm, width 400E may be about 1.5 cm, width 400F may be about 1.6 cm, and width 400G may be about 1.6 cm, although other configurations are contemplated.

With continued reference to FIG. 4A, the material strand 130 may have a first total width 410 and a second total width 412 orthogonal to the first total width 410. The first and second widths 410, 412 may be equal or substantially equal, or the first total width 410 may be different than the second total width 412. For example, the second total width 412 may be greater than the first total width 410. In one example, the first total width 410 may be about 6 cm, and the second total width 412 may be about 6.8 cm, although other configurations are contemplated.

FIGS. 4B-4K are diagrams illustrating example cut configurations to form the material strand 130, according to one or more embodiments of the disclosure. Depending on the application, material may be cut (e.g., spirally cut, rotationally cut, etc.) about one or two rotation points to define the material strand 130. For instance, referring to FIGS. 4B-4C, starting from the center of the 2D spiral 312, first and second cuts 430, 432 may be made about a first center 434 to at least partially define the second end 150 (e.g., the rounded end 152). As shown, each of the first cut 430 and the second cut 432 may be a circular arc subtending 90-degrees about the first center 434. The first and second cuts 430, 432 may be defined by a first radius 436 such that the first and second cuts 430, 432 together define a first semicircle about first center 434 with first radius 436.

Figure 4B:
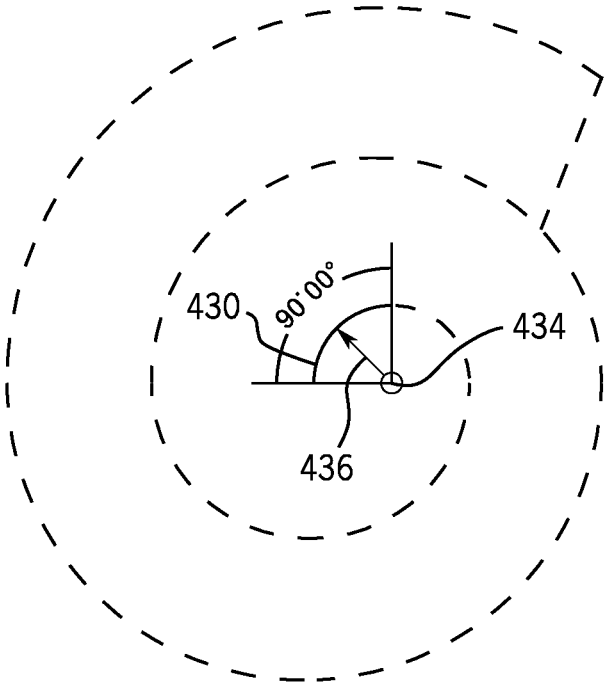
FIGS. 4B-4K are diagrams illustrating example cut configurations to form the material strand, according to one or more embodiments of the disclosure.
Figure 4C:
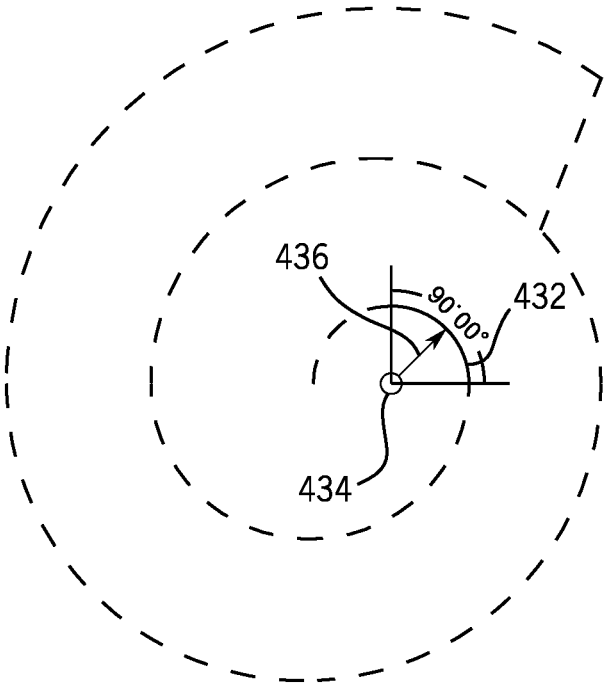
Figure 4D:
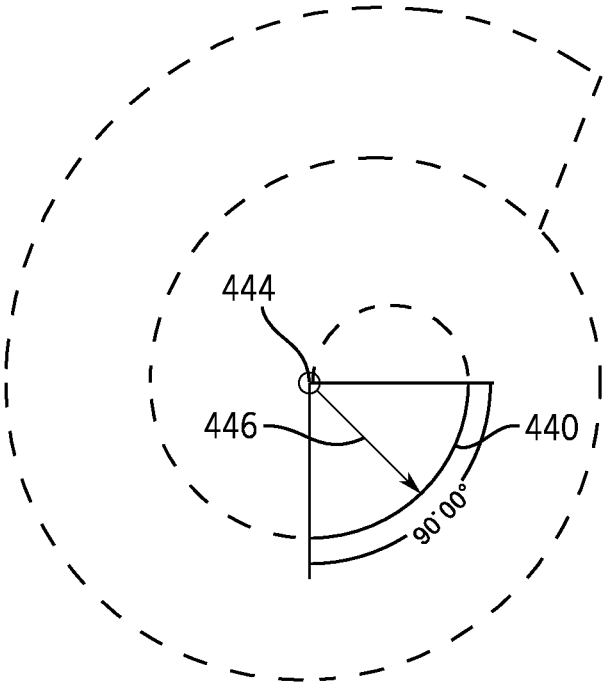
Figure 4E:
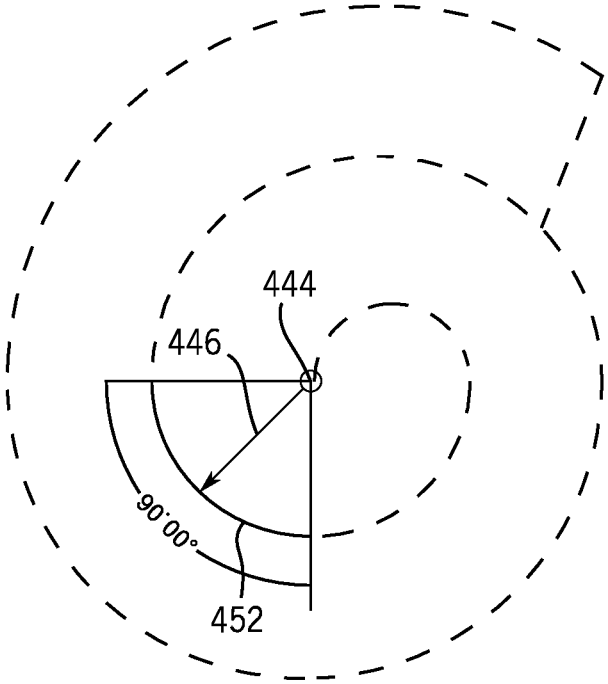

Referring to FIGS. 4D-4E, third and fourth cuts 440, 442 may be made about a second center 444. As shown, the second center 444 may be defined at the start of the first cut 430. As shown, each of the third cut 440 and the fourth cut 442 may be a circular arc subtending 90-degrees about the second center 444. The third and fourth cuts 440, 442 may be defined by a second radius 446 greater than the first radius 436. In embodiments, the third and fourth cuts 440, 442 may together define a first semicircle about second center 444 with second radius 446.

Figure 4F:
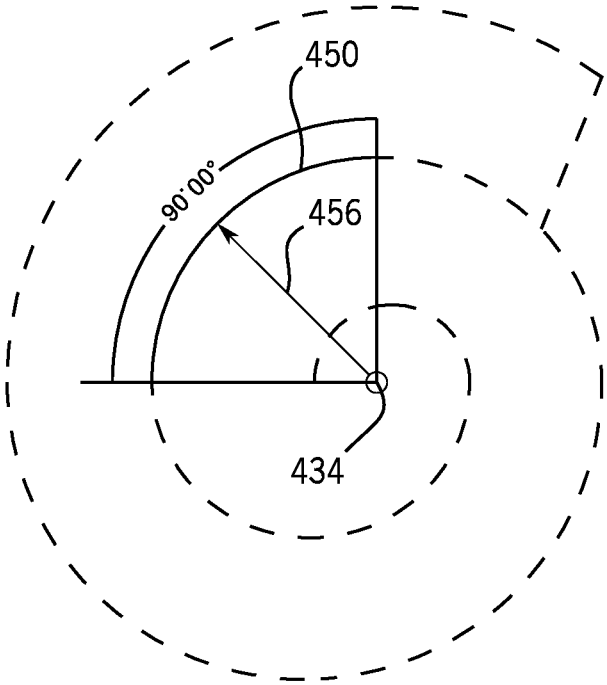
Figure 4G:
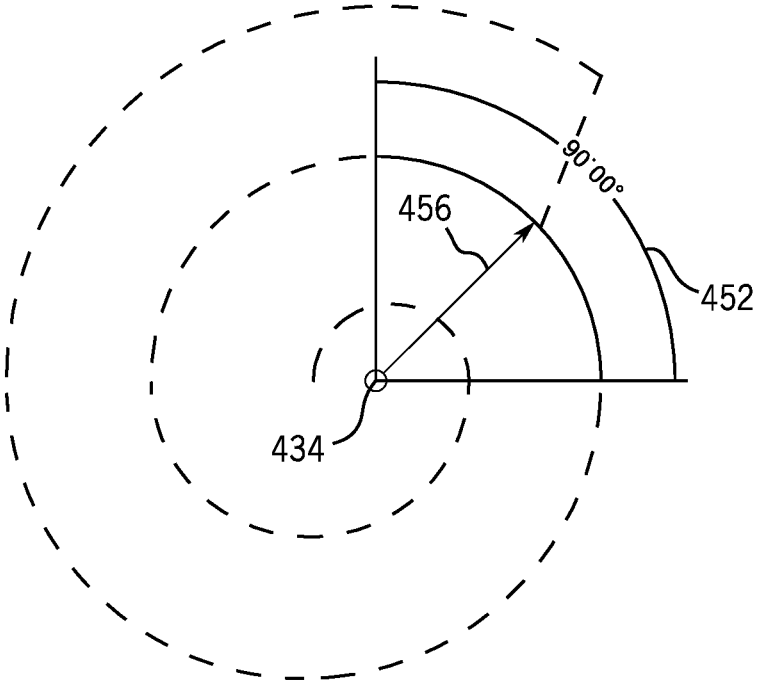

Referring to FIGS. 4F-4G, fifth and sixth cuts 450, 452 may be made about first center 434. Each of the fifth cut 450 and the sixth cut 452 may be a circular arc subtending 90-degrees about first center 434. The fifth and sixth cuts 450, 452 may be defined by a third radius 456 greater than the first radius 436 and the second radius 446. In embodiments, the fifth and sixth cuts 450, 452 may together define a second semicircle about first center 434 with third radius 456.

Figure 4H:
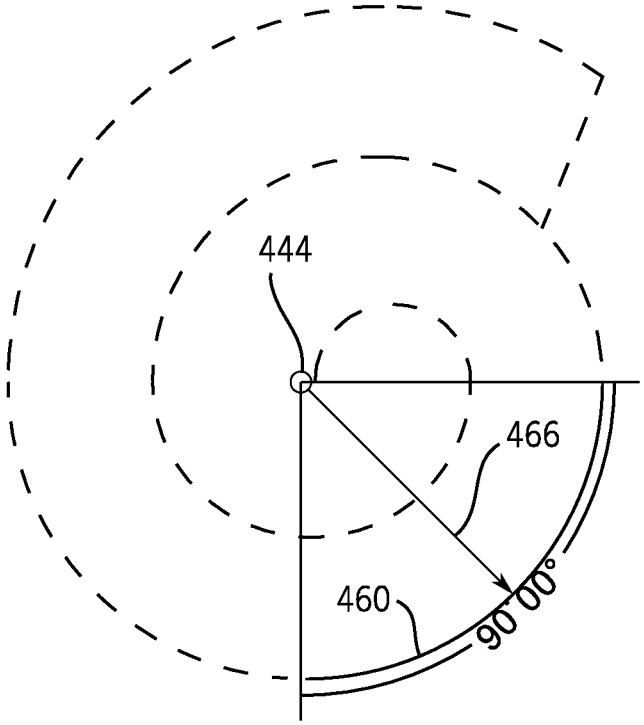
Figure 4I:
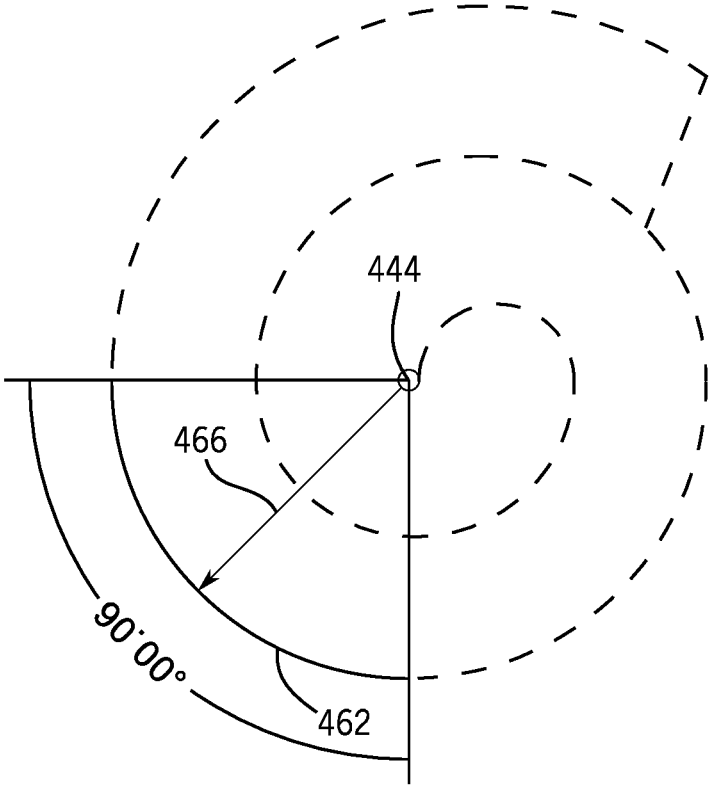

Referring to FIGS. 4H-4I, seventh and eighth cuts 460, 462 may be made about second center 444. Each of the seventh cut 460 and the eighth cut 462 may be a circular arc subtending 90-degrees about second center 444. The seventh and eighth cuts 460, 462 may be defined by a fourth radius 466 greater than the first radius 436, the second radius 446, and the third radius 456. In embodiments, the seventh and eighth cuts 460, 462 may together define a second semicircle about second center 444 with fourth radius 466.

Figure 4J:
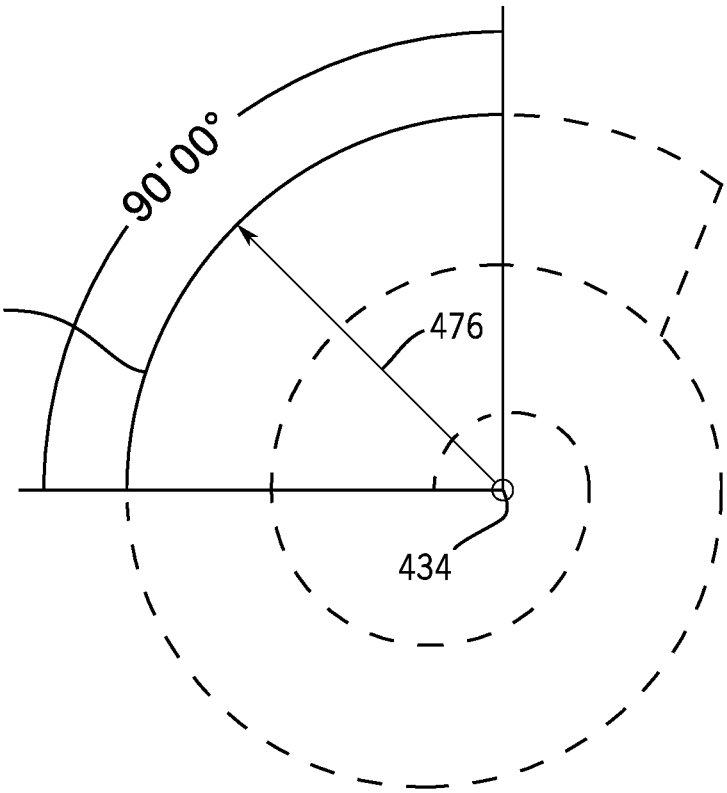
Figure 4K:
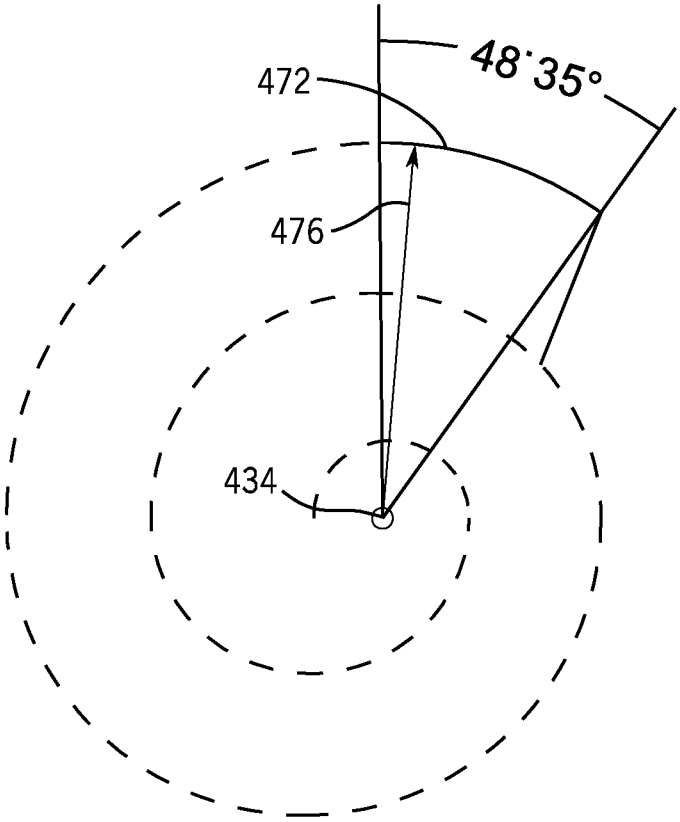

Referring to FIGS. 4J-4K, ninth and tenth cuts 470, 472 may be made about first center 434. The ninth cut 470 may be a circular arc subtending 90-degrees about first center 434. As shown, the tenth cut 472 may be a circular arc subtending 48.35-degrees about first center 434, although other configurations are contemplated, including greater than 48.35-degrees or less than 48.35-degrees. The ninth and tenth cuts 470, 472 may be defined by a fifth radius 476 greater than the first radius 436, the second radius 446, the third radius 456, and the fourth radius 466.

Figure 5:
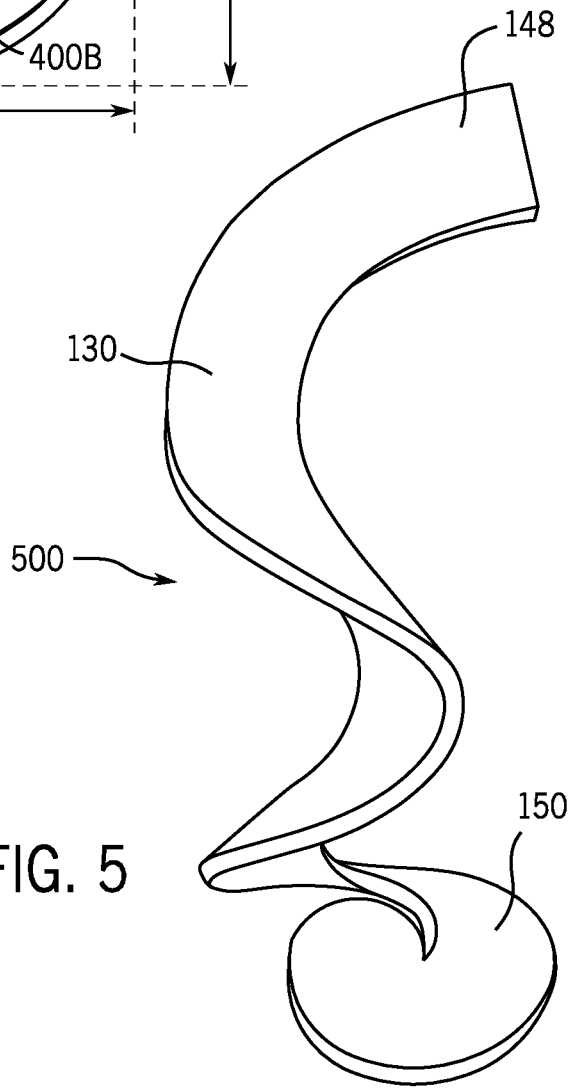
FIG. 5 is a perspective view of the formed material strand defining a 3D helix, according to one or more embodiments of the disclosure.

FIG. 5 is a perspective view of a single material strand 130, according to one or more embodiments of the disclosure. When extended, such as in its natural extended state, each material strand 130 may define a 3D helix 500 formed by the 2D spiral 312 cut into a flat piece of flexible material. The 3D helix 500 may include various shapes defined by the material strand 130 twisting or wrapping (e.g., around a center axis) as the second end 150 of the material strand 130 extends away from the first end 148 to define the strand's curl. Depending on the application, the 3D helix 500 may be defined by a wide or narrow strand of material. A wide strand may define a shorter and/or wider curl, and a narrow strand may define a longer and/or narrower curl. In this manner, the shape of the doll's curls may be defined as desired.

Figure 6:
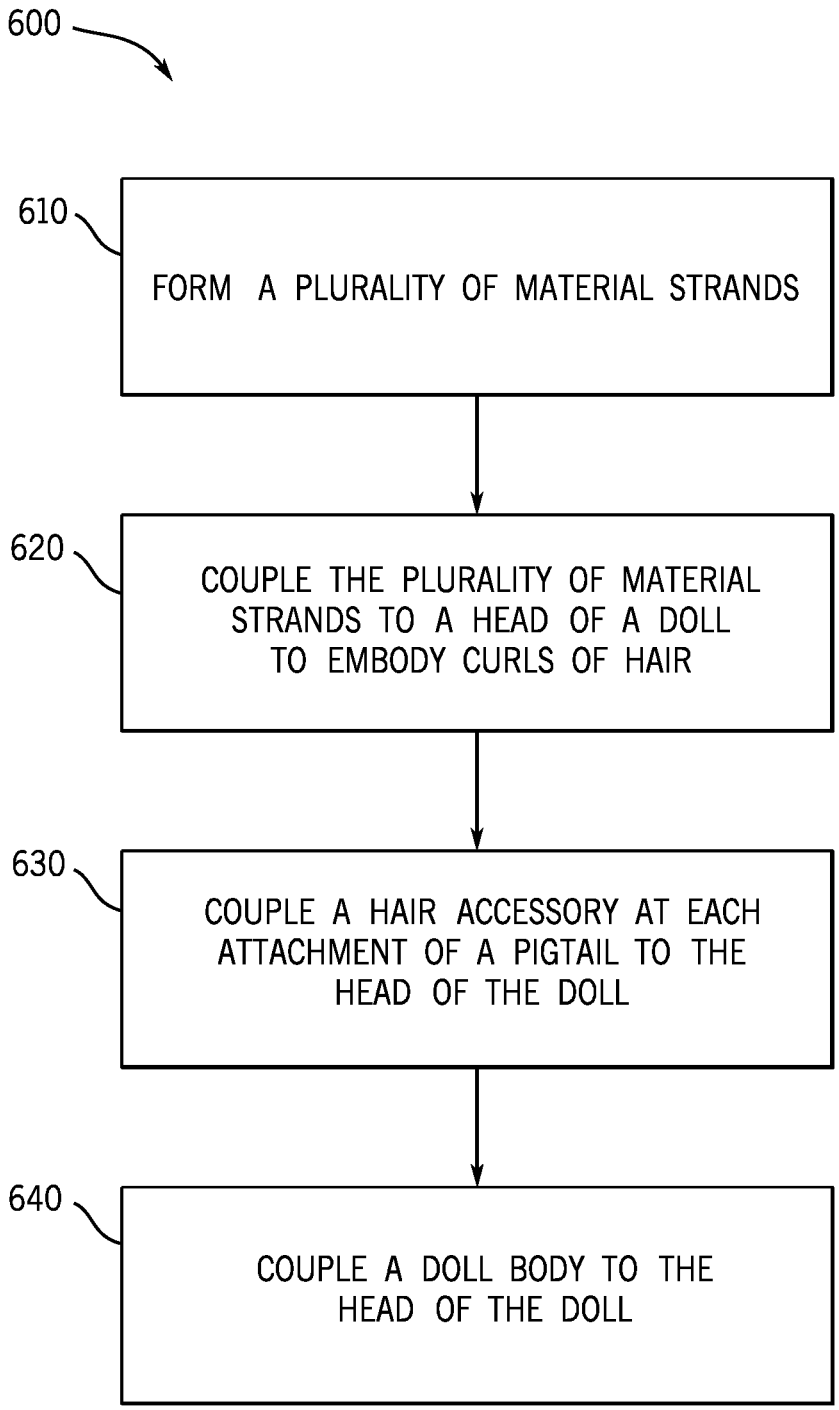
FIG. 6 is a flowchart of a method of making a doll, according to one or more embodiments of the disclosure.

FIG. 6 is a flowchart of a method 600 of making a doll, according to one or more embodiments of the disclosure. For explanatory purposes, the method 600 is described herein with reference to FIGS. 1-5, although the method 600 is not limited to the embodiments illustrated in FIGS. 1-5. Note that one or more operations in FIG. 6 may be combined, omitted, and/or performed in a different order as desired.

In block 610, the method 600 includes forming a plurality of material strands. The material strands may be similar to the material strands 130 described above. For example, each material strand may define a 3D helix (e.g., 3D helix 500) formed by a 2D spiral (e.g., 2D spiral 312) cut into a flat piece of flexible material. The 2D spiral may include an Archimedean spiral, an involute spiral, or an Atzema spiral, among other spiral shapes, as described above. Each material strand may include a first end attached to the doll's head, and an unattached second end, as described above. In embodiments, block 610 may include stamping the 2D spiral into the flat piece of flexible material (e.g., using die 300), such as in the manner and shapes described above.

In block 620, the method 600 includes coupling the plurality of material strands to a head of a doll (e.g., to the head 106 of doll 100), such as in a manner as described above. For instance, block 620 may include coupling the first plurality of material strands 132 together to define the first pigtail 134, and coupling the second plurality of material strands 140 together to define the second pigtail 142. In such embodiments, block 620 may include coupling the first and second pigtails 134, 142 to opposite sides of the doll's head. Although two pigtails are shown and described, any number of pigtails may be coupled to the doll, such as no pigtails, one pigtail, or more than two pigtails. In this manner, the term "pigtail" is to be construed broadly as bunches of hair extending from the doll's head, whether in a true pigtail fashion or otherwise.

In block 630, the method 600 includes coupling a hair accessory (e.g., hair accessory 160) at each attachment of a pigtail to the doll's head. The hair accessory may include at least one of a bow, a pin, a band, or a clamp, as described above.

In block 640, the method 600 includes coupling a body (e.g., body 108) to the head of the doll. As detailed above, the body may include various combinations of arms and/or legs attached to a torso, such as two or more legs, two arms, or fewer than two arms, or any combination thereof. In this manner, the doll may embody a human or an animal as desired.

While certain exemplary embodiments of the invention have been described and shown in the accompanying drawings, it is to be understood that such embodiments are merely illustrative of and not restrictive on the broad invention, and that the embodiments of the invention not be limited to the specific constructions and arrangements shown and described, since various other modifications may occur to those ordinarily skilled in the art. The intention is to cover all modifications, equivalents and alternatives falling within the spirit and scope of the disclosure as defined by the claims.

For example, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments. In addition, while different steps, processes, and procedures are described as appearing as distinct acts, one or more of the steps, one or more of the processes, and/or one or more of the procedures may also be performed in different orders, simultaneously, and/or sequentially. In some embodiments, the steps, processes, and/or procedures may be merged into one or more steps, processes, and/or procedures. In some embodiments, one or more of the operational steps in each embodiment may be omitted.

What is claimed is:

1. A doll comprising:

a head; and a plurality of material strands coupled to the head to embody curls of hair, wherein each material strand defines a three-dimensional (3D) helix formed by a two-dimensional (2D) spiral cut into a flat piece of flexible material.

2. The doll of claim 1, wherein the 2D spiral is stamped into the flat piece of flexible material.

3. The doll of claim 1, wherein the 2D spiral comprises an Archimedean spiral, an involute spiral, or an Atzema spiral.

4. The doll of claim 1, wherein each material strand comprises:

a first end attached to the head; and an unattached second end comprising a rounded end.

5. The doll of claim 1, wherein the plurality of material strands comprises:

a first plurality of material strands coupled together to define a first pigtail; and a second plurality of material strands coupled together to define a second pigtail.

6. The doll of claim 5, wherein the first and second pigtails are coupled to opposite sides of the head.

7. The doll of claim 5, further comprising a hair accessory at each attachment of a pigtail to the head.

8. The doll of claim 7, wherein the hair accessory comprises at least one of a bow, a pin, a band, or a clamp.

9. The doll of claim 1, further comprising a body coupled to the head.

10. The doll of claim 1, wherein the doll embodies a human.

11. A method of making a doll, the method comprising:

coupling a plurality of material strands to a head of the doll, wherein each material strand defines a three-dimensional (3D) helix formed by a two-dimensional (2D) spiral cut into a flat piece of flexible material.

12. The method of claim 11, further comprising forming the plurality of material strands, wherein the forming comprises stamping the 2D spiral into the flat piece of flexible material.

13. The method of claim 11, wherein the 2D spiral comprises an Archimedean spiral, an involute spiral, or an Atzema spiral.

14. The method of claim 11, wherein each material strand comprises:

a first end attached to the head; and an unattached second end.

15. The method of claim 11, wherein the coupling comprises:

coupling a first plurality of material strands together to define a first pigtail; and coupling a second plurality of material strands together to define a second pigtail.

16. The method of claim 15, wherein the coupling the plurality of material strands to the head of the doll comprises coupling the first and second pigtails to opposite sides of the head.

17. The method of claim 15, further comprising coupling a hair accessory at each attachment of a pigtail to the head.

18. The method of claim 17, wherein the hair accessory comprises at least one of a bow, a pin, a band, or a clamp.

19. The method of claim 11, further comprising coupling a body to the head.

20. The method of claim 11, wherein the doll embodies a human.

* * * * *